United States Patent [19]

Moulin

[11] 4,090,771

[45] May 23, 1978

[54] CONTACT ASSEMBLY WITH ROTATIONAL LOCK FOR WIRE WRAP TERMINATION

[75] Inventor: Norbert L. Moulin, Placentia, Calif.

[73] Assignee: Hughes Aircraft Company, Culver City, Calif. 90230

[21] Appl. No.: 723,357

[22] Filed: Sep. 15, 1976

Related U.S. Application Data

[63] Continuation of Ser. No. 597,253, Jul. 18, 1975, abandoned.

[51] Int. Cl.[2] ..... H01R 13/40

[52] U.S. Cl. ..... 339/217 S; 339/221 R; 339/276 A

[58] Field of Search ..... 339/88, 188, 214–217, 339/220, 221, 276 A; 174/94 R

[56] References Cited

U.S. PATENT DOCUMENTS

| | | | |
|---|---|---|---|
| 2,272,379 | 2/1942 | Loukota et al. | 339/215 R |
| 2,464,405 | 3/1949 | Knauf, Jr. | 339/220 T |
| 2,962,691 | 11/1960 | Mande et al. | 339/221 L |
| 3,397,377 | 8/1968 | Potter | 339/88 C |

FOREIGN PATENT DOCUMENTS

| | | | |
|---|---|---|---|
| 1,811,826 | 9/1969 | Germany | 339/221 L |
| 2,304,688 | 8/1973 | Germany | 339/220 C |

*Primary Examiner*—Joseph H. McGlynn
*Attorney, Agent, or Firm*—Lewis B. Sternfels; W. H. MacAllister

[57] ABSTRACT

A crimp type contact having a wire wrap post secured thereto is prevented from rotating within an insulation block when a conductor is wrapped around the post by a small stamped sheet metal spur attached to the contact which is so configured that, when the contact is installed into its cavity in the insulation body, the spur bites into the walls of the cavity.

9 Claims, 3 Drawing Figures

CONTACT ASSEMBLY WITH ROTATIONAL LOCK FOR WIRE WRAP TERMINATION

This is a continuation of application Ser. No. 597,253 filed July 18, 1975, now abandoned.

BACKGROUND OF THE INVENTION

1. Field of the Invention

The present invention relates to a non-rotational electrical contact having a wire wrap termination post secured thereto.

2. Description of the Prior Art

Conventional crimp type contacts can rotate when installed into a connector body e.g., by virtue of a retaining system such as illustrated in my U.S. Pat. No. 3,792,416; thus, it has not been possible to attach a conductor to the contact by a wire wrap method. Specifically, the wrapping operation transmits torques to the contact and cannot be accomplished if the contact rotates.

SUMMARY OF THE INVENTION

The present invention overcomes this and other problems by providing an electrical contact having a wire wrap termination post extending therefrom, in which means is secured to the contact for preventing rotation of the contact assembly once it is installed and otherwise retained in a connector block.

It is, therefore, an object of the present invention to provide for a contact assembly having a wire wrap termination post coupled thereto.

Another object is to provide for such a contact having means for preventing rotation thereof for enabling wire wrapping of electrical conductors to the posts.

Other aims and objects as well as a more complete understanding of the present invention will appear from the following explanation of an exemplary embodiment and the accompanying drawings thereof.

BRIEF DESCRIPTION OF THE DRAWINGS

Referring now to FIGS. 1 and 2, a contact assembly 10 comprises an electrical contact 12 configured, for example, as a socket contact, having a socket section 14 therein for receiving a mating pin of a pin contact. It is to be understood, however, that socket section 14 may comprise a pin so that contact assembly 10 may comprise a pin contact assembly rather than the illustrated socket contact assembly. As similarly shown in my U.S. Pat. No. 3,792,416, for example, contact assembly 10 is retained within a connector body by means of a retaining clip 15 of spring material. Clip 15 retains the contact assembly in its connector body only from axial movement, but does not prevent relative rotation therebetween.

Figure 1:
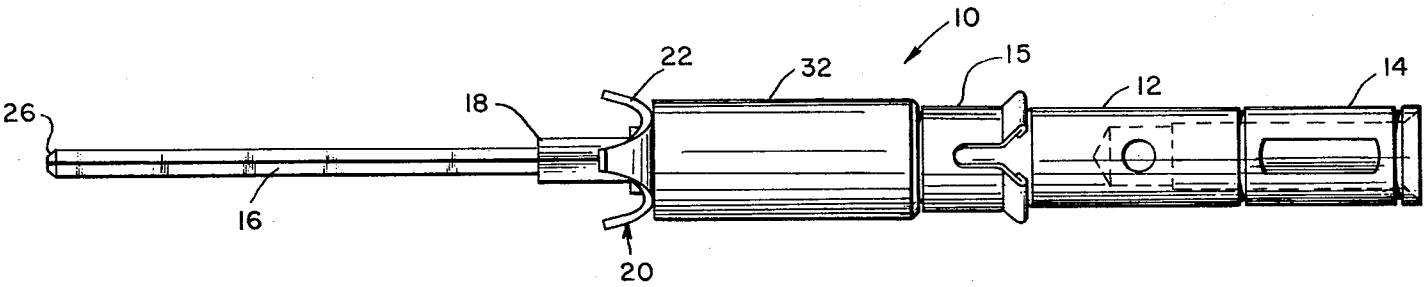
FIG. 1 is side view of the present invention in elevation.

Regardless of the particular pin or socket configuration of the contact assembly, a post extension 16 extends from contact 12 and, preferably, is formed integral therewith, such as by a screw machining operation. In general, post extension 16 comprises a wire wrap termination which is utilized in the conventional manner for wire wrapping an electrical conductor therearound. Extension 16, at the point where it joins contact 12, includes a section 18 of general square shape, although other shapes of a non-circular configuration may be utilized.

Placed onto section 18 is a small spur 20 which includes a plurality of resilient fingers 22. Preferably, spur 20 is formed from stamped sheet metal which has a central opening 24 whose shape is substantially the same as that of section 18 so as to form a non-rotatable connection therewith. Spur 20 may be swaged or press-fitted onto section 18 or directly onto post 16 to retain the spur on the contact assembly and also, in conjunction with the non-circular mating configuration, to rotationally lock the two together. Thus, the combination of clip 15 and spur 20 respectively prevent axial and rotational motion of contact assembly 10 in its insulation body 36.

Fingers 22 of spur 20 are bent backward towards free end 26 of post extension 16 and preferably are squared at their distal ends 28 to form biting corners 30 and edges 31. The bending of fingers 22 are such that they extend outwardly to a greater extent than the exterior surface 32 of contact 12 and a cavity 34 of an insulation body 36 into which contact assembly 10 is to be inserted.

Figure 3:
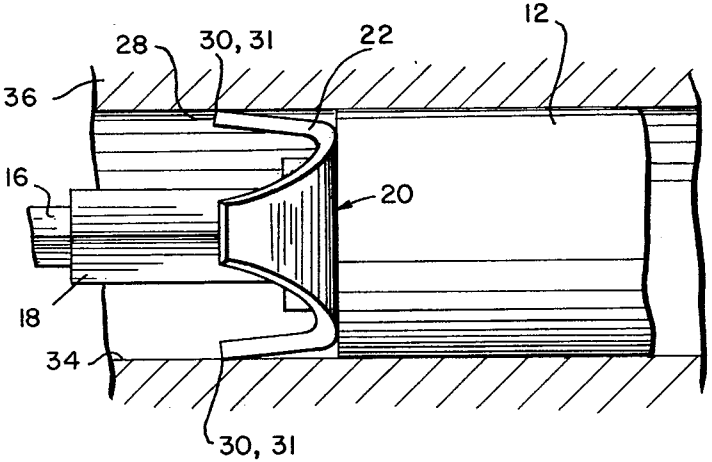
FIG. 3 illustrates the contact of FIGS. 1 and 2 placed non-rotatably within an insulation body.
Figure 2:
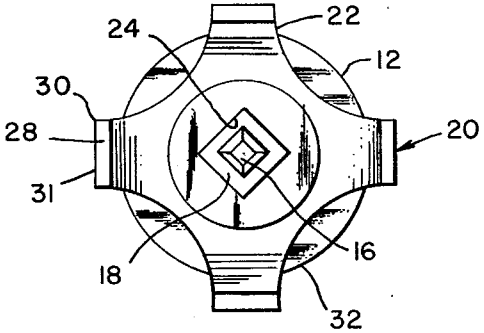
FIG. 2 is a end view of the invention shown in FIG. 1.

As shown in FIG. 3, as the contact assembly is installed into contact cavity 34, corners 30 and edges 31 of spur 20 bite into the walls of the cavity and prevent the contact assembly from rotating. Thus, wire wrapping about extension 16 may take place. Furthermore, installation of conventional crimp type contacts or wire wrap contacts may be randomly positioned in a connector block, along with the required contact float to insure reliable connector operation.

The bending of fingers 22 are preferably such as to be substantially parallel, albeit inclined, with respect to cavity 34 so as to enable removal of contact assembly 10 from connector block if desired, it being understood that such removal would result in a slight scoring of the walls of the cavity.

The configuration of spur 20 is such as to provide for easy automation, such as from a die strip which can be manufactured with minimum material usage and which can be processed on belts and automatically cut, swaged or otherwise worked, and formed for use by the assembly operator.

Although the invention has been described with reference to a particular embodiment thereof, it should be realized that various changes and modification may be made therein without departing from the spirit and scope of the invention.

What is claimed is:

1. An electrical connector having therein at least one non-rotatable contact assembly for wire wrap termination comprising:

a connector body having means therein for defining at least one contact-receiving cavity;

at least one electrical contact positioned in said cavity means;

a retention clip rotatably mounted on said contact and axially retaining said contact in said cavity means;

a post extending from one end of said contact for enabling a conductor to be wrapped and electrically coupled to and around said post; and means otherwise independent from said axial retaining means secured to said contact means, engaged with a wall of said contact-receiving cavity means and resisting rotation of said contact with respect to said cavity means when the conductor is wrapped and electrically coupled to and around said post.

2. A connector and contact assembly as in claim 1 further including a section of generally polygonal cross-section joining said post with said contact and wherein said rotation resisting means includes means for defining an opening of generally polygonal cross-section substantially the same as that of said section, said rotation resisting means being mounted on said section in non-rotatable cooperation therewith by engagement of said opening means with said section.

3. A connector and contact assembly as in claim 1 wherein said rotation resisting means comprises a spur having at least one finger extending substantially radially outwardly from and beyond the surface of said contact and into engagement with said cavity wall.

4. A connector and contact assembly as in claim 3 wherein said finger comprises resilient material bent towards the end of said post, and resiliently deformed and biting into said cavity wall.

5. A connector and contact assembly as in claim 1 wherein said rotation resisting means comprises four fingers of springy material extending substantially radially outwardly from and beyond the surface of said contact, each of said fingers being spaced substantially orthogonally from an adjacent one of said fingers and having a distal end extending towards the end of said post and into engagement with said cavity wall.

6. A connector and contact assembly as in claim 5 wherein each of said fingers is substantially squared at said distal end thereof for defining pointed corners and squared edges therebetween which dig into said cavity wall and thereby resist the rotation of said contact and said post means with respect to said cavity means.

7. A connector and contact assembly comprising:

a connector body having therein at least one contact-receiving opening;

at least one electrical contact in the opening;

a wire-wrap post integrally secured to said contact for enabling an electrical conductor to be wrapped and electrically coupled to said post;

retaining means secured to said contact for enabling said contact to be axially secured in the connector body opening yet to be removed therefrom; and means secured to said contact and otherwise separate from and non-cooperative with said axial securing means and grippable with the opening for preventing rotation of said contact with respect to said connector body from rotational torques exerted on said contact when the electrical conductor is wrapped around and electrically coupled to said wire-wrap post.

8. A method, usable in combination with an existing retention system for a contact which has means engageable with a contact-receiving opening in a connector body for resisting axial motion of the contact with respect to the connector body and which has a wire-wrap post for enabling wrapping of an electrical conductor thereto, the improvement for substantially preventing rotation of the contact with respect to the connector body by the wrapping of the electrical connector about the wire-wrap post, in addition to the means for resisting the contact axial motion, comprising the steps of:

providing at least one spur on the contact in addition to, separate from and non-cooperative with the axial retention system;

inserting the contact and the spur into the connector body opening;

causing the spur to dig into the cavity wall means while the axial motion resisting means concurrently engages the contact-receiving opening; and wrapping the electrical conductor about the wire-wrap post, the cooperation only between the spur and the cavity wall resisting rotational moments exerted on the contact during said wrapping step.

9. A method as in claim 8 further comprising the step of bending the spur prior to said inserting step.

* * * * *